US012275550B2

(12) United States Patent
Zwaga

(10) Patent No.: US 12,275,550 B2
(45) Date of Patent: Apr. 15, 2025

(54) METHOD FOR TOP SEALING A CARDBOARD TRAY LINED WITH A PLASTIC FOIL AND CARDBOARD TRAY THEREFOR

(71) Applicant: Packable B.V., Almelo (NL)

(72) Inventor: Ronald Zwaga, Almelo (NL)

(73) Assignee: Packable B.V. (NL)

( * ) Notice: Subject to any disclaimer, the term of this patent is extended or adjusted under 35 U.S.C. 154(b) by 179 days.

(21) Appl. No.: 17/793,165

(22) PCT Filed: Jan. 7, 2021

(86) PCT No.: PCT/EP2021/050181
§ 371 (c)(1),
(2) Date: Jul. 15, 2022

(87) PCT Pub. No.: WO2021/144187
PCT Pub. Date: Jul. 22, 2021

(65) Prior Publication Data

US 2023/0051796 A1 Feb. 16, 2023

(30) Foreign Application Priority Data

Jan. 16, 2020 (EP) ..... 20152305

(51) Int. Cl.
*B65D 77/20* (2006.01)
*B65B 7/28* (2006.01)
(Continued)

(52) U.S. Cl.
CPC ..... *B65B 7/2878* (2013.01); *B65B 43/265* (2013.01); *B65B 51/14* (2013.01);
(Continued)

(58) Field of Classification Search
CPC ..... B65D 5/563; B65D 5/2047; B65D 5/246; B65D 2577/2025; B65D 77/2024;
(Continued)

(56) References Cited

U.S. PATENT DOCUMENTS 4,200,481 A * 4/1980 Faller ..... B29C 51/165 156/499
4,257,530 A * 3/1981 Faller ..... B65B 9/04 229/905
(Continued)

FOREIGN PATENT DOCUMENTS

EP 2687360 A1 1/2014
EP 2441697 B1 8/2014
(Continued)

*Primary Examiner* — Andrew M Tecco
(74) *Attorney, Agent, or Firm* — The Webb Law Firm

(57) ABSTRACT

The invention relates to a method for top sealing a cardboard tray lined with a plastic foil. The method includes the steps of providing a cardboard tray having a bottom, upstanding walls arranged along the periphery of the bottom and a horizontal flange arranged along the upper edges of the upstanding walls, wherein the inside of the cardboard tray is lined with a plast foil, which plastic foil extends at least onto the horizontal flange; arranging the cardboard tray in a lower sealing tool member having a compressible support edge, wherein at least the horizontal flange is supported by the compressible support edge of the lower sealing tool member; arranging a cover foil over the cardboard tray arranged in the lower sealing tool member to cover the opening of the tray defined by the upper edges of the upstanding walls; and pressing a heated upper sealing tool member onto the lower sealing tool member, wherein the cover foil, the plastic foil liner and the horizontal flange are pressed together to seal the cover foil onto the plastic foil liner along the horizontal flange. The overlapping area of the plastic foil liner, the cover foil, and the compressible support edge extends at least partially outside of the area of the horizontal flange.

4 Claims, 4 Drawing Sheets

(51) Int. Cl.

| | |
|---|---|
| ***B65B 43/26*** | (2006.01) |
| ***B65B 51/14*** | (2006.01) |
| ***B65D 5/20*** | (2006.01) |
| ***B65D 5/56*** | (2006.01) |

(52) U.S. Cl.
CPC ..... *B65D 5/2047* (2013.01); *B65D 5/563* (2013.01); *B65D 77/2024* (2013.01); *B65B 2220/02* (2013.01); *B65D 2577/2025* (2013.01)

(58) Field of Classification Search
CPC ..... B65D 1/34; B65B 7/2878; B65B 31/028; B31B 2120/404
See application file for complete search history.

(56) References Cited

U.S. PATENT DOCUMENTS

| | | | | | |
|---|---|---|---|---|---|
| 5,253,801 | A * | 10/1993 | Bernstein | B65D 5/2047 | 229/113 |
| 5,492,703 | A * | 2/1996 | Gics | B65D 25/205 | 426/106 |
| 9,415,887 | B2 * | 8/2016 | Zwaga | B65B 7/28 | |
| 10,647,466 | B2 * | 5/2020 | Zwaga | B65D 5/563 | |
| 10,899,494 | B2 * | 1/2021 | Suokas | B32B 3/04 | |
| 11,034,481 | B2 * | 6/2021 | Suokas | B65D 5/56 | |
| 11,691,778 | B2 * | 7/2023 | Zwaga | B65D 5/243 | 229/113 |
| 2004/0094611 | A1 * | 5/2004 | van Eijndhoven | B65D 5/60 | 229/125.35 |
| 2013/0327821 | A1 * | 12/2013 | Zwaga | B65D 5/563 | 53/403 |
| 2015/0217884 | A1 * | 8/2015 | Zwaga | B32B 37/10 | 156/196 |
| 2018/0237180 | A1 | 8/2018 | Zwaga et al. | | |
| 2019/0077573 | A1 * | 3/2019 | Suokas | B65D 25/16 | |
| 2019/0092515 | A1 * | 3/2019 | Suokas | B65D 77/2024 | |

FOREIGN PATENT DOCUMENTS

| | | | | |
|---|---|---|---|---|
| EP | 3130548 | A1 | 2/2017 | |
| FR | 2826938 | A1 | 1/2003 | |
| WO | 0220359 | A2 | 3/2002 | |
| WO | 2017158233 | A1 | 9/2017 | |
| WO | WO-2017158239 | A1 * | 9/2017 | B32B 1/00 |

* cited by examiner

METHOD FOR TOP SEALING A CARDBOARD TRAY LINED WITH A PLASTIC FOIL AND CARDBOARD TRAY THEREFOR

CROSS-REFERENCE TO RELATED APPLICATIONS

This application is the United States national phase of International Application No. PCT/EP2021/050181 filed Jan. 7, 2021, and claims priority to European Patent Application No. 20152305.7 filed Jan. 16, 2020, the disclosures of which are hereby incorporated by reference in their entirety.

BACKGROUND OF THE INVENTION

Field of the Invention

The invention relates to a method for top sealing a cardboard tray lined with a plastic foil, which method comprises the steps of:

- providing a cardboard tray having a bottom, upstanding walls arranged along the periphery of the bottom and a horizontal flange arranged along the upper edges of the upstanding walls, wherein the inside of the cardboard tray is lined with a plastic foil, which plastic foil extends at least onto the horizontal flange;
- arranging the cardboard tray in a lower sealing tool member having a compressible support edge, wherein at least the horizontal flange is supported by the compressible support edge of the lower sealing tool member;
- arranging a cover foil over the cardboard tray arranged in the lower sealing tool member to cover the opening of the tray defined by the upper edges of the upstanding walls;
- pressing a heated upper sealing tool member onto the lower sealing tool member, wherein the cover foil, the plastic foil liner and the horizontal flange are pressed together to seal the cover foil onto the plastic foil liner along the horizontal flange.

Description of Related Art

Such a method is for example known from EP 2441697.

When sealing the cover foil onto the horizontal flange of the cardboard tray, any unevenness in the top surface of the horizontal flange poses a risk for a leak between the cover foil and the plastic liner foil arranged on the horizontal flange. A leak in the seal is especially for modified atmosphere packaging unacceptable, as the contents of the packaging will not benefit of the modified atmosphere due to the leak, with the result that the contents will deteriorate quicker.

In EP 2441697 the risk for a leak is minimized by having the horizontal flange to be composed out of flange parts, which form a flat upper surface. But even on the transition between two adjacent flange parts a risk of leakage occurs, especially when there is a small gap between the edges of two adjacent flange parts.

EP 2687360 provides an improvement to decrease the risk of leakage by leaving a part of the plastic foil liner loose from the horizontal flange, such that when the cover foil is sealed, the loose part of the plastic foil liner is in better contact with the cover foil and a better seal is achieved.

EP 3130548 discloses another solution to decrease the risk of leakage. In this publication it is proposed to provide a bulge in the plastic foil liner, which bulge extends over the transition between two flange parts of a horizontal circumferential flange. The bulge will ensure a better contact between the plastic foil liner and the cover foil, such that the potential disadvantage of a gap between the flange parts at this transition is remedied.

SUMMARY OF THE INVENTION

It is however an object to provide an alternative method for sealing a cover foil on a cardboard tray lined with a plastic foil, wherein the risk of leakage is reduced.

This object is achieved according to the invention with a method for the top sealing of a cardboard tray lined with a plastic foil, which is characterized in that in view of the pressing direction, the overlapping area of the plastic foil liner, the cover foil and the compressible support edge extends at least partially outside of the area of the horizontal flange.

With the method according to the invention, it is ensured that during sealing of the cover foil on the cardboard tray, parts of the cover foil and plastic foil liner are pressed between the lower sealing tool member and the heated upper sealing tool member, without any other parts, in particular cardboard parts, present, which could distort the pressure on both foils. With the method according to the invention the cover foil and plastic foil liner are sealed directly by the upper and lower sealing tool members without interposition of cardboard parts of the tray.

The compressible support edge of the lower sealing tool member allows for accommodating the differences in thickness of the overlapping area of the plastic foil liner, the cover foil and the compressible support edge extends at least partially outside of the area of the horizontal flange and the area not extending outside of the area of the horizontal flange.

It is noted that the cover foil could also be the plastic foil liner of another piece of cardboard, such as a lid or another cardboard tray to form a so-called clam shell packaging.

The other piece of cardboard with plastic foil liner, which is sealed onto the tray as a cover foil, could also be provided in a similar way as the cardboard tray of the invention. The upper sealing tool should then also be provided with a compressible edge, such that the plastic foil liner extending outside of the area of the cardboard can be pressed onto the plastic foil liner of the cardboard tray of the invention.

In a preferred embodiment of the method according to the invention the compressible support edge of the lower sealing tool is a compressible rubber or plastic band.

Such a compressible rubber of plastic band easily deforms and accommodates to changes in thickness and even allows for relative small areas extending outside of the area of the horizontal flange to be sufficiently supported by the lower sealing tool member to allow a reliable seal of the plastic foil liner with the cover foil.

In a further preferred embodiment of the method according to the invention, when the upper sealing tool member is pressed onto the lower sealing tool member, the compressible rubber or plastic band abuts against the plastic liner foil where, in view of the pressing direction, the overlapping area of the plastic foil liner, the cover foil and the compressible support edge extends at least partially outside of the area of the horizontal flange.

If for example the plastic foil liner extends on all sides of the tray beyond the outer circumference of the horizontal flange, a fully closed peripheral seal between cover foil and plastic foil liner is obtained, which seal is not influenced by any unevenness of the cardboard of the horizontal flange.

The invention further relates to a cardboard tray for use in the method according to the invention, which cardboard tray comprises:

- a bottom;
- upstanding walls arranged along the periphery of the bottom;
- a horizontal flange arranged along the upper edges of the upstanding walls; and
- plastic foil lined against the inside of the cardboard tray, which plastic foil extends at least onto the horizontal flange and extends, in view of a direction perpendicular to the horizontal flange, at least partially outside of the area of the horizontal flange.

In a preferred embodiment of the cardboard tray according to the invention, the plastic foil extends from the inside of the cardboard tray, onto the horizontal flange and at least partially beyond the outer edge of the horizontal flange. With this embodiment a fully closed peripheral seal between cover foil and plastic foil liner can be obtained by using the method of the invention.

In yet another preferred embodiment of the cardboard tray according to the invention the cardboard tray is folded from a cardboard blank, wherein the horizontal flange is composed out of horizontal flange portions, which are each arranged on the upper edge of a respective upstanding wall.

Folding the cardboard tray from a cardboard blank allows for forming the cardboard tray, filling the tray with contents and closing the tray by sealing a cover foil on a single production line. Preferably the cardboard blank is folded by pushing the blank into a mould, after which a heated plastic foil is laminated into the folded cardboard blank by using a pressure difference, such as described in for example EP 2441697. Because of the cuts and folds of the cardboard tray, low pressure can build up below the heated plastic foil, while a higher pressure is present above the heated plastic foil. This allows for the plastic foil to be sucked into the cardboard tray once a sufficient pressure difference is present over the plastic foil. When no specific suction openings are provided, the cuts can function as pressure valves, such that the low pressure enters the cardboard tray suddenly, once a certain threshold has been reached.

It is however also possible to form the cardboard tray by adhering cardboard parts together either fully separate parts or parts from a single piece.

In another preferred embodiment of the cardboard tray according to the invention, at the transition from one horizontal flange portion to an adjacent horizontal flange portion an opening is provided in the horizontal flange, and wherein the plastic foil liner covers said opening.

The main dimension of the opening are substantially larger than the small gap, which occurs when two horizontal flange parts abut. The main dimension of the opening is preferably more than 5 millimeters. The opening allows for the compressible support edge of the lower sealing tool member to penetrate the opening and support the plastic foil liner covering the opening, such that a good sealing with the cover foil is obtained.

In yet another embodiment of the cardboard tray according to the invention, between two upstanding walls with a horizontal flange portion arranged thereto, an upstanding wall without a horizontal flange portion is provided and wherein at least part of the upper edge of the upstanding wall without a horizontal flange portion is spaced apart from the horizontal flange, such that an opening is provided between the upstanding wall and the horizontal flange.

The opening formed between the upstanding wall and the horizontal flange also allows for the compressible support edge to penetrate the opening to support the plastic foil liner covering this opening and allow for a reliable seal with the cover foil.

In still a further preferred embodiment of the cardboard tray according to the invention, in view of a direction perpendicular to the bottom, the shape of the bottom is an octagon having four sets of parallel edges of equal length.

In yet another preferred embodiment of the cardboard tray according to the invention at least one of the upstanding walls is provided with a flap arranged on the edge of the upstanding wall bordering an adjacent upstanding wall, wherein the flap overlaps and abuts said adjacent upstanding wall, wherein the flap is provided with an opening, which is covered by the plastic foil lining, such that the plastic foil lining is attached to the adjacent upstanding wall via the opening in the flap.

The opening in the flap allows for a positional locking of the flap relative to the upstanding wall the flap overlaps with. This positional locking is achieved by the plastic foil liner, which is laminated against the inside of the cardboard tray and thus extends over the flap and the opening. The plastic foil liner is adhered to the upstanding walls, the bottom, the flap and via the opening in the flap to the upstanding wall part covered by the flap. This ensures that the tray shape is reliably retained by the plastic foil liner, without any need to separately adhere the flaps to the upstanding walls.

BRIEF DESCRIPTION OF THE DRAWINGS

These and other features of the invention will be elucidated in conjunction with the accompanying drawings.

DESCRIPTION OF THE INVENTION

Figure 1A:
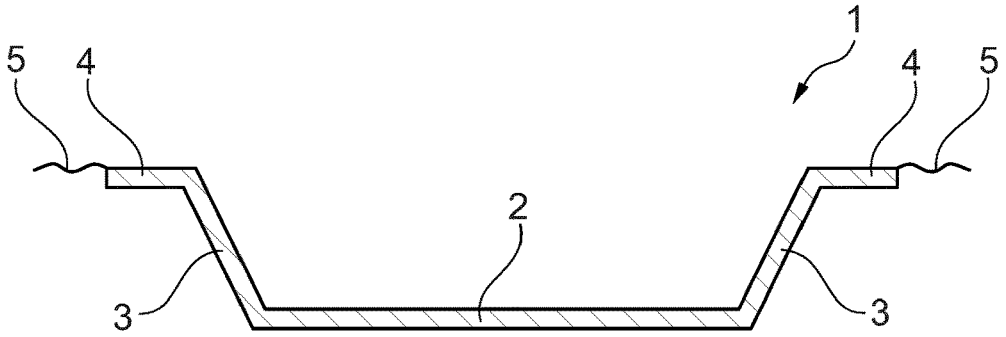
FIGS. 1A-1C show schematically the steps of an embodiment of the method according to the invention.

FIG. 1A shows a first step of an embodiment of the method according to the invention. In this step a cardboard tray 1 is provided. The cardboard tray 1 has a bottom 2, upstanding walls 3 and a horizontal flange 4 arranged on the upper edges of the upstanding walls 3.

The inside of the tray 1 is lined with a plastic foil 5, which runs over the bottom 2, the upstanding walls 3, the horizontal flange 4 and extends beyond the outer edge of the horizontal flange 4.

Figure 1B:
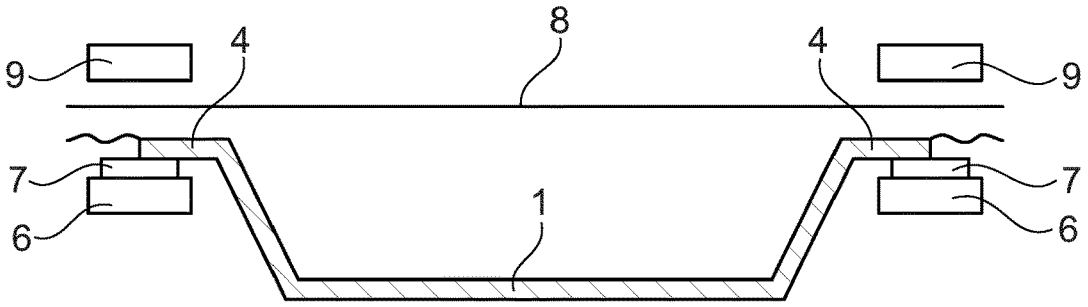

In FIG. 1B the cardboard tray 1 is supported with the horizontal flange 4 on a lower sealing tool member 6, which is provided with a compressible support edge 7 made out of a compressible rubber band.

In this step a cover foil 8 is arranged over the cardboard tray 1 and a heated upper sealing tool member 9 is positioned there above.

Figure 1C:
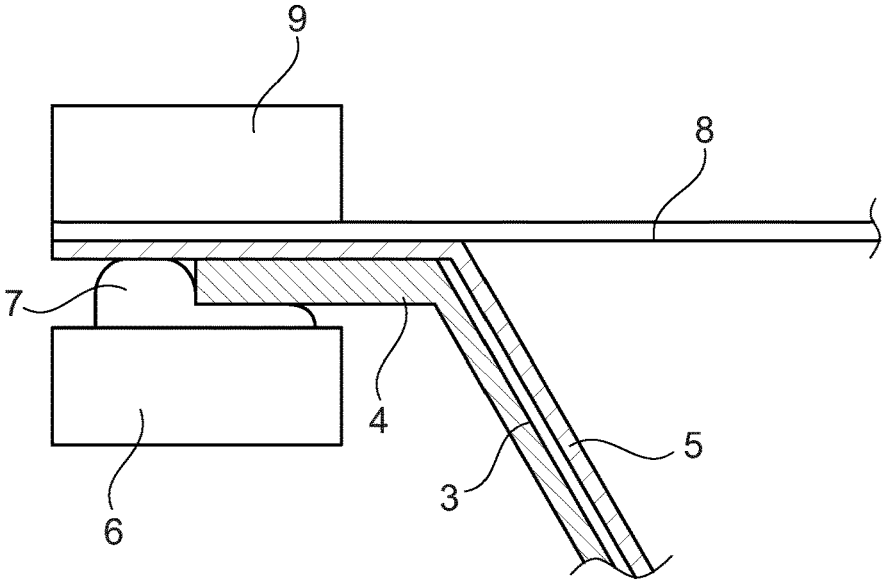

In FIG. 1C the next step of the method according to the invention is shown. The heated upper sealing tool member 9 is pressed down onto the cover foil 8, the plastic foil liner 5, the horizontal flange 4 and the lower sealing tool member 6.

Due to the pressure exerted by the upper sealing tool member 9 the compressible rubber band 7 will deform and ensure that the part of the plastic foil liner 5 extending beyond the outer edge of the horizontal flange 4 is also pressed against the cover foil 8, such that a reliable seal is obtained between the plastic foil liner 5 and the cover foil 8.

Figure 2A:
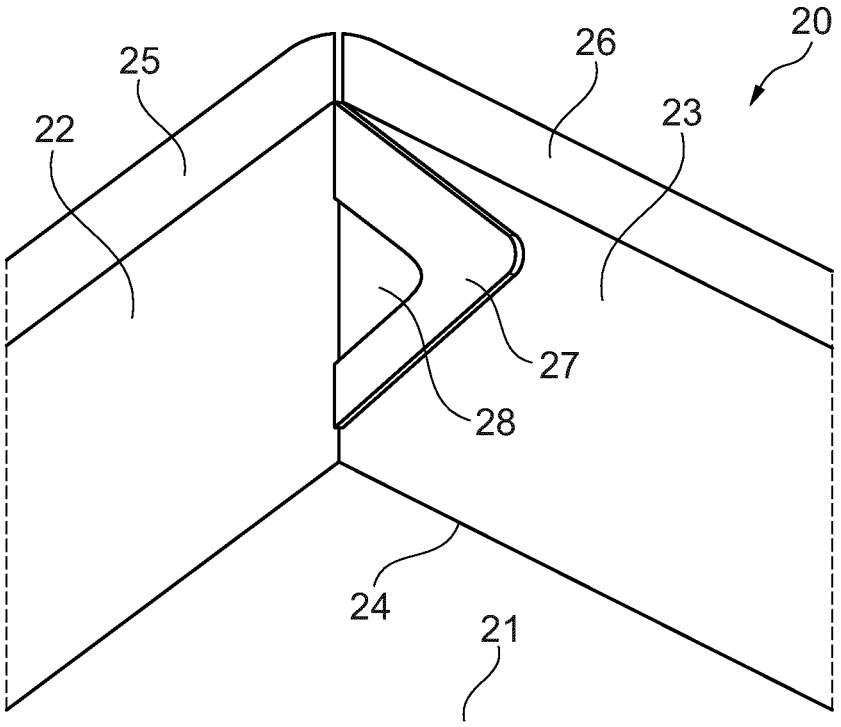
FIGS. 2A and 2B show respectively a perspective view and a cross-section of a first embodiment of a cardboard tray according to the invention.

FIG. 2A shows a perspective view of a first embodiment of a cardboard tray 20 according to the invention, which is folded out of a cardboard blank. The tray 20 has a bottom 21 with upstanding walls 22, 23 arranged along the periphery 24 of the bottom 21.

A horizontal flange 25, 26 is composed out of horizontal flange portions 25, 26, which are arranged to the upper edge of a respective upstanding wall 22, 23.

The upstanding wall 22 is provided with a flap 27, which has an opening 28. The flap 27 overlaps and abuts with the adjacent upstanding wall 23.

Figure 2B:
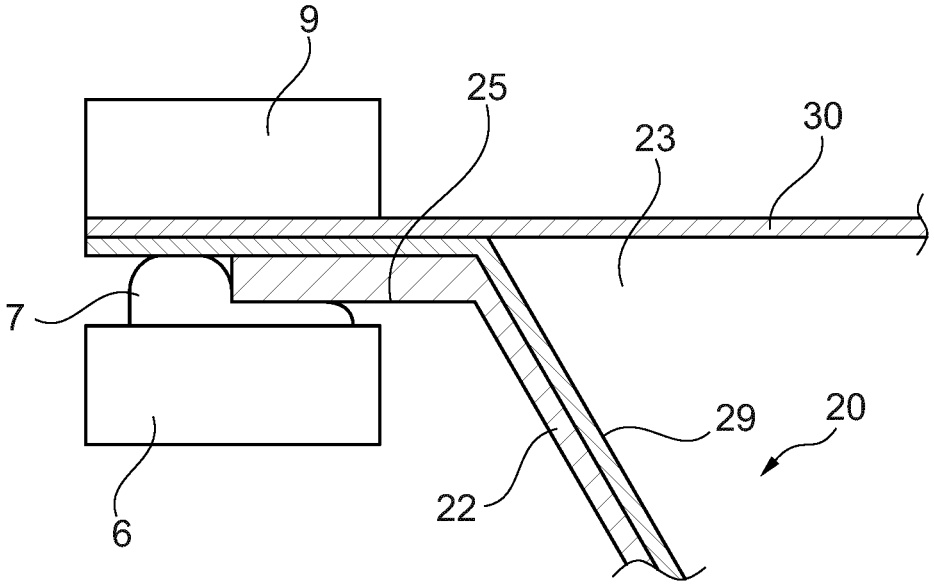

FIG. 2B shows a cross-section of the cardboard tray 20 arranged in a sealing tool with a heated upper sealing tool member 9 and a lower sealing tool member 6 with a compressible rubber band 7, such as disclosed in FIGS. 1A-1C.

The cardboard tray 20 is lined on the inside with a plastic foil 29, which extends over the horizontal flange part 25 and beyond the outer edge thereof. Due to the compressible rubber band 7, the plastic foil 24 is support also outside of the horizontal flange 25, such that a reliable seal with the cover foil 30 is obtained.

Figure 3A:
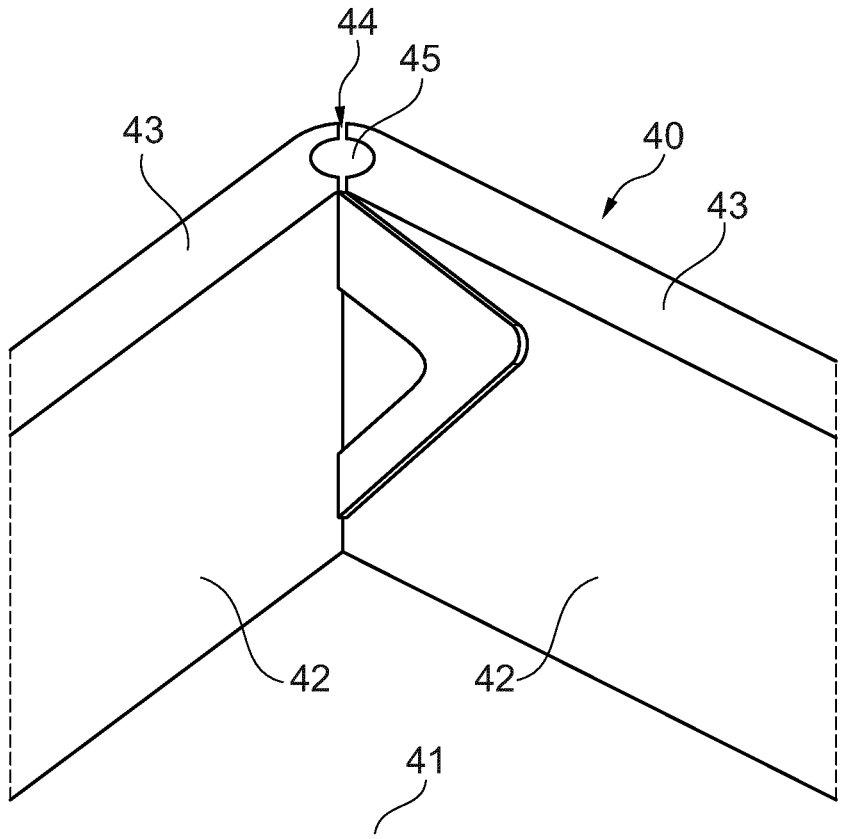
FIGS. 3A and 3B show respectively a perspective view and a cross-section of a second embodiment of a cardboard tray according to the invention.

FIG. 3A shows a perspective view of a second embodiment of a cardboard tray 40 according to the invention. The tray 40 is folded from a cardboard blank and has a bottom 41, upstanding walls 42 and horizontal flange parts 43, similar to the embodiment of FIGS. 2A and 2B.

Figure 3B:
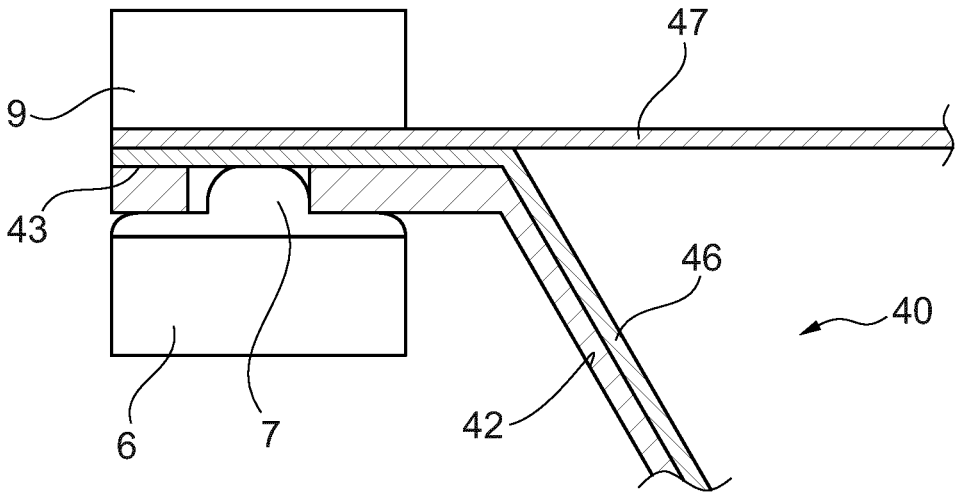

At the transition 44 of adjacent horizontal flange parts 43, an opening 45 is provided. As shown in FIG. 3B this opening 45 is covered by a plastic foil liner 46, which extends from the bottom 41, over the upstanding walls 42 and the horizontal flange 43.

When the cardboard tray 40 is compressed together with a cover foil 47 between the lower and upper sealing tool members 6, 9, the compressible rubber band 7 deforms into the opening 45, such that also the part of the plastic foil liner 46 covering the hole 45 is sufficiently supported to obtain a reliable seal with the cover foil 47.

Figure 4A:
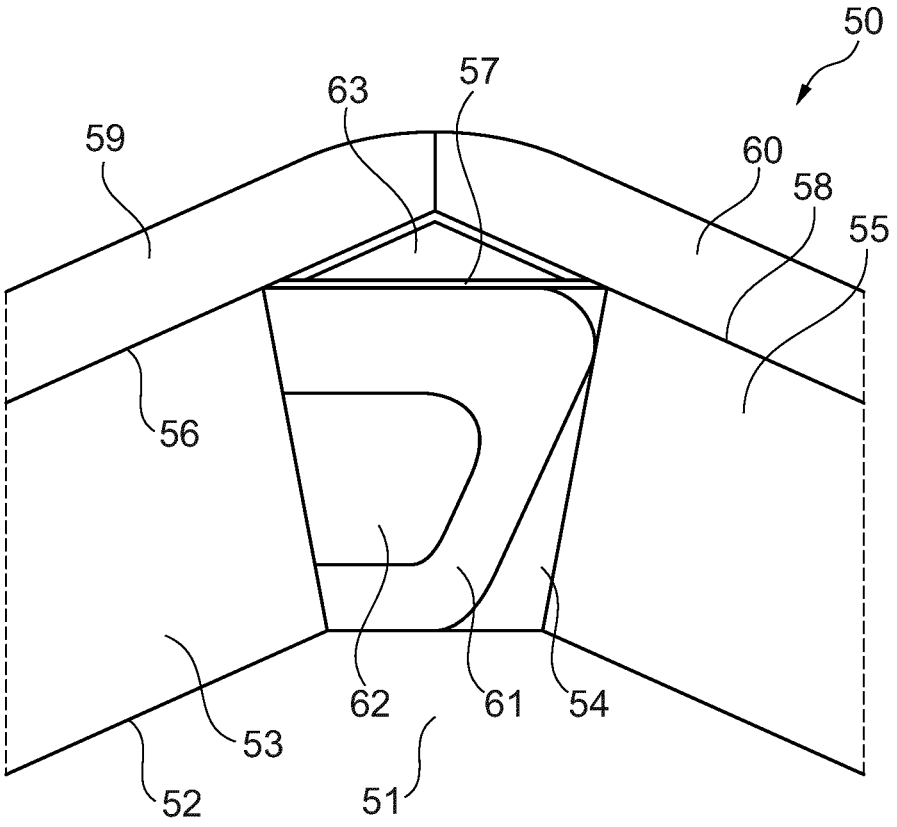
FIGS. 4A and 4B show respectively a perspective view and a cross-section of a third embodiment of a cardboard tray according to the invention.

FIG. 4A shows a perspective view of a third embodiment of a cardboard tray 50 according to the invention. The cardboard tray 50 has an octagonal shaped bottom 51 with along its periphery 52 upstanding walls 53, 54, 55. At the upper edge 56, 58 of the upstanding walls 53, 55 respectively a horizontal flange part 59, 60 is arranged.

The upstanding wall 54, arranged adjacent to both the upstanding walls 53, 55 does not have a horizontal flange part, such that an opening 63 is formed.

Figure 4B:
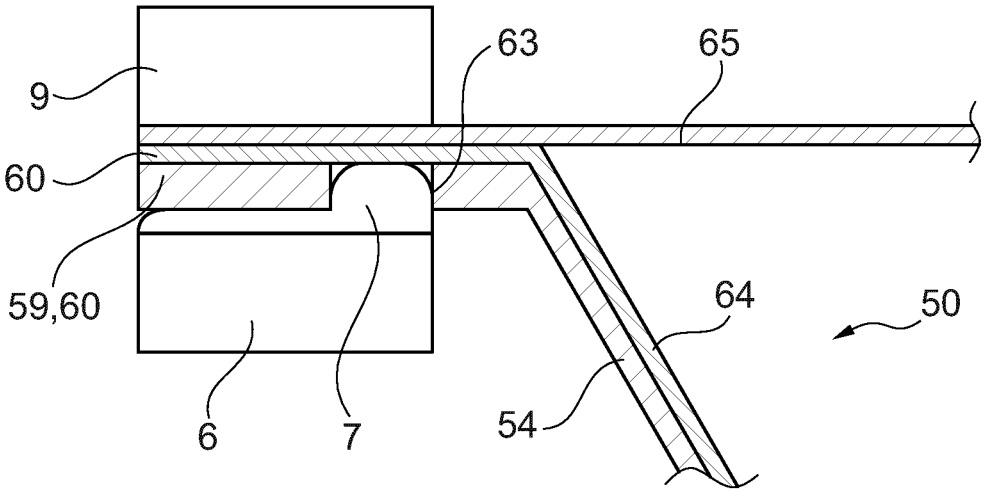

The upstanding wall 53 has a flap 61 with opening 62, which overlaps and abuts with the upstanding wall 54. As shown in FIG. 4B, the inside of the tray 50 is lined with a plastic foil 64, which also runs over the flap 61 and adheres via the opening 62 to the underlying upstanding wall 54, such that the folded cardboard retains its shape.

When the cardboard tray 50 is positioned in a sealing tool having a heated upper sealing tool member 9 and a lower sealing tool member 6 with a compressible rubber band 7, the rubber band 7 will deform into the opening 63. As a result the deformed rubber band 7 will also support the plastic foil liner 64 extending over the opening 63, such also at this position a good seal with the cover foil 65 is obtained.

The invention claimed is:

1. A method for top sealing a cardboard tray lined with a plastic foil, which method comprises the steps of:

providing a cardboard tray having a bottom, upstanding walls arranged along the periphery of the bottom and a horizontal flange arranged along the upper edges of the upstanding walls, wherein the inside of the cardboard tray is lined with a plastic foil, which plastic foil extends at least onto the horizontal flange;

arranging the cardboard tray in a lower sealing tool member having a compressible support edge, wherein at least the horizontal flange is supported by the compressible support edge of the lower sealing tool member;

arranging a cover foil over the cardboard tray arranged in the lower sealing tool member to cover the opening of the tray defined by the upper edges of the upstanding walls; and pressing a heated upper sealing tool member onto the lower sealing tool member, wherein the cover foil, the plastic foil and the horizontal flange are pressed together to seal the cover foil onto the plastic foil along the horizontal flange, wherein in view of the pressing direction, the overlapping area of the plastic foil, the cover foil and the compressible support edge of the lower sealing member extends at least partially outside of the area of the horizontal flange, the compressible support edge being configured to press directly against both the plastic foil and the horizontal flange during performance of the pressing step.

2. The method according to claim 1, wherein the compressible support edge of the lower sealing tool is a compressible rubber or plastic band.

3. The method according to claim 2, wherein, when the upper sealing tool member is pressed onto the lower sealing tool member, the compressible rubber or plastic band abuts against the plastic foil where, in view of the pressing direction, the overlapping area of the plastic foil, the cover foil and the compressible support edge extends at least partially outside of the area of the horizontal flange.

4. The method according to claim 1, wherein the compressible support edge is positioned to extend at least partially outside the area of the horizontal flange and at least partially underneath the horizontal flange when viewed in the pressing direction.

* * * * *